US007740386B2

(12) United States Patent
Tsuji et al.

(10) Patent No.: US 7,740,386 B2
(45) Date of Patent: Jun. 22, 2010

(54) LIGHTING APPARATUS CABLE AND LIGHTING APPARATUS USING THE SAME

(75) Inventors: Ryuhei Tsuji, Anan (JP); Tsuyoshi Yasuoka, Anan (JP)

(73) Assignee: Nichia Corporation, Anan-shi (JP)

( * ) Notice: Subject to any disclaimer, the term of this patent is extended or adjusted under 35 U.S.C. 154(b) by 148 days.

(21) Appl. No.: 12/071,920

(22) Filed: Feb. 27, 2008

(65) Prior Publication Data

US 2008/0205059 A1 Aug. 28, 2008

(30) Foreign Application Priority Data

Feb. 28, 2007 (JP) ..... P2007-49912

(51) Int. Cl.
*F21V 21/00* (2006.01)

(52) U.S. Cl. ..... 362/391; 362/249.02; 362/249.04; 362/806; 439/505; 439/679

(58) Field of Classification Search ..... 362/249.01, 362/249.02, 249.04, 249.14, 391; 439/66, 439/460, 505, 679
See application file for complete search history.

(56) References Cited

U.S. PATENT DOCUMENTS

| | | | | |
|---|---|---|---|---|
| 5,038,001 | A | 8/1991 | Koegel et al. | |
| 5,125,846 | A * | 6/1992 | Sampson et al. | 439/66 |
| 5,238,424 | A | 8/1993 | Vindum | |
| 6,660,935 | B2 | 12/2003 | Southard et al. | |
| 6,777,891 | B2 | 8/2004 | Lys et al. | |
| 7,160,140 | B1 * | 1/2007 | Mrakovich et al. | 439/417 |
| 7,217,012 | B2 | 5/2007 | Southard et al. | |
| 2003/0057886 | A1 | 3/2003 | Lys et al. | |
| 2004/0115984 | A1 * | 6/2004 | Rudy et al. | 439/405 |
| 2005/0207151 | A1 | 9/2005 | Aanegola et al. | |
| 2007/0064450 | A1 | 3/2007 | Chiba et al. | |

FOREIGN PATENT DOCUMENTS

| | | | |
|---|---|---|---|
| JP | 2002-088722 | A | 3/2002 |
| JP | 2004-103383 | A | 4/2004 |
| JP | 2005-032649 | A | 2/2005 |
| JP | 2005-033158 | A | 2/2005 |
| JP | 2005-515481 | A | 5/2005 |
| JP | 2006-107797 | A | 4/2006 |
| JP | 2008-52237 | A | 3/2008 |
| WO | WO-02/43220 | A1 | 5/2002 |
| WO | WO-02/097770 | A2 | 12/2002 |

* cited by examiner

*Primary Examiner*—Ali Alavi
(74) *Attorney, Agent, or Firm*—Birch, Stewart, Kolasch & Birch, LLP

(57) ABSTRACT

The present invention provides the lighting apparatus cable that allows it to easily attach the lighting module and enables it to improve the productivity. A flat cable used in a lighting apparatus having a plurality of lighting modules disposed in series, for connecting the lighting modules in such a manner that colors and/or luminous intensities of emitted lights of the lighting modules can be controlled, the flat cable comprising: at least four conductors disposed in parallel which include two signal conductors disposed at both sides of the cable and two power feeding conductors; a sheath member covering the at least four conductors to integrate; and notches formed on both sides of the cable so as to cut the signal conductors.

27 Claims, 14 Drawing Sheets

LIGHTING APPARATUS CABLE AND LIGHTING APPARATUS USING THE SAME

BACKGROUND OF THE INVENTION

1. Field of the Invention

The present invention relates to a lighting apparatus cable and a lighting apparatus that uses the same, and particularly to a cable used in a lighting apparatus for illumination consisting of a plurality of light sources connected together, and the lighting apparatus that uses the same.

2. Description of the Related Art

An illumination consisting of a plurality of LEDs connected together consumes less power and does not have the problem of burnout in comparison to an illumination consisting of the conventional electric bulbs, and is therefore used widely for outdoor illumination purposes. Such an illumination that is constituted from a plurality of LEDs connected with each other by flexible electric cables in either linear or network configuration, may be secured on a structure such as roadside tress or the wall of a building and then is lighted.

For connecting the plurality of LEDs, such a method is known as two electrically conducting terminals having pointed ends are pierced through a sheath that covers two power feeding conductors of positive and negative poles, so that the electrically conducting terminals are electrically connected to the power feeding conductor of positive and negative poles to supply power to the LEDs via the electrically conducting terminals (refer to, for example, Published Japanese Translation No. 2005-515481 of the PCT Application and Japanese Unexamined Patent Publication (Kokai) No. 2004-103383). This method makes it possible to connect the LEDs to the power feeding conductors at any desired point without need to strip the sheath of the power feeding conductors or to solder the power feeding conductors and the electrically conducting terminals together.

A lighting system in which lighting module comprising LEDs and a controller is connected to a conduit that includes two power feeding conductors of positive and negative poles and one signal conductor is also known (refer to, for example, U.S. Pat. No. 6,777,891). Cutting contacts may be used to connect the lighting module, the power feeding conductors and the signal conductor. The cutting contacts allow it to penetrate into the conduit and electrically connect the power feeding conductors or the signal conductor, so as to supply electric power and signals to the lighting module via the cutting contacts. In the constitution described in U.S. Pat. No. 6,777,891, the conduit has a through hole formed to cut the signal conductor, and the cutting contacts are pierced to each end of the signal conductor that has been cut. This constitution enables electric signals sent to the signal conductor to propagate through the lighting module.

Such an illumination as described above requires it to connect positive electrode and negative electrode of the LED correctly to the power feeding conductors of positive and negative poles, respectively, when attaching a plurality of LEDs to one cable. It is also necessary to attach the plurality of LEDs to one cable at predetermined intervals. Moreover, it is also required to attach the LEDs efficiently in order to improve the productivity of manufacturing the illumination.

The technologies described in Published Japanese Translation No. 2005-515481 of the PCT Application and Japanese Unexamined Patent Publication (Kokai) 2004-103383 involve the possibility of incorrectly connecting the positive electrode and the negative electrode of the LED to the power feeding conductors, and these patents do not disclose any means for setting the distance between the LEDs to the predetermined interval. As a result, it takes extensive attention and labor to attach the LEDs at the predetermined intervals while ensuring the correct pole, and therefore it is difficult to improve the productivity.

The technology described in U.S. Pat. No. 6,777,891 involves not only the possibility of incorrectly connecting the positive electrode and the negative electrode of the LED to the power feeding conductors, but also it is highly probable that the cutting contacts may be incorrectly connected because there exist the cutting contact for feeding power and the cutting contact for sending signals in a mixed state. The lighting module may be easily positioned at the predetermined intervals by providing the lighting module with locating pins that enable it to fit into through holes formed on the signal conductor. However, orientation of the lighting module cannot be determined by the locating pins. As a result, great care is required when attaching the LEDs to ensure the correct pole, and therefore it is difficult to improve the productivity.

SUMMARY OF THE INVENTION

Accordingly, an object of the present invention is to provide a lighting apparatus cable that enables it to improve the productivity and a lighting apparatus that uses the same.

A first lighting apparatus cable of the present invention is a flat cable used in a lighting apparatus having a plurality of lighting modules disposed in series, for connecting the lighting modules in such a manner that colors and/or luminous intensities of emitted lights of the lighting modules can be controlled, the flat cable comprising: at least four conductors disposed in parallel which include two signal conductors disposed at both sides of the cable and two power feeding conductors; a sheath member covering the at least four conductors to integrate; and notches formed on both sides of the cable so as to cut the signal conductors.

As used herein, the phrase "disposed in parallel" is used to mean that the electrical conductors are disposed with the longitudinal axes thereof substantially parallel to each other.

Since the two signal conductors are separated from each other in the first lighting apparatus cable of the present invention, there is less possibility of interference between electric signals propagating over the signal conductors and therefore it is less probable that the electric signals would be contaminated by noise. Also, when the lighting apparatus cable is used together with the lighting module, the position where the lighting module is to be attached can be determined simply by providing a protrusion on the lighting module for fitting in the notch of the cable. Moreover, since fitting the protrusion in the notch of the cable causes the cable to be held between the protrusions of the lighting module, the cable and the lighting module can be securely fastened to each other temporarily until the lighting modules are fully fastened onto the cable. This makes it easier to assemble the lighting modules with the cable, thus increasing the efficiency of manufacturing. It is also made possible to dispose the LEDs at the predetermined intervals simply by fitting the protrusion into the notch of the cable.

The first lighting apparatus cable is preferably used for the lighting module that has a control device which requires two signal conductors.

A second lighting apparatus cable of the present invention is a flat cable used in a lighting apparatus having a plurality of lighting modules disposed in series, for connecting the lighting modules in such a manner that colors and/or luminous intensities of emitted lights of the lighting modules can be controlled, the flat cable comprising: at least three conductors disposed in parallel which include one signal conductor disposed at one side of the cable and two power feeding conductors; a sheath member covering the at least three conductors to integrate; and notch formed on the one side of the cable so as to cut the signal conductor.

When the second lighting apparatus cable is used together with the lighting module, the position where the lighting module is to be fastened can be determined simply by providing a protrusion on the lighting module for fitting in the notch of the cable. Moreover, the cable and the lighting module can be fastened to each other temporarily until the lighting modules are fully fastened onto the cable, by fitting the protrusion in the notch of the cable. Accordingly, it becomes easier to assemble the lighting module onto the cable, and the efficiency of manufacturing can be improved. It is also made possible to dispose the LEDs at the predetermined intervals simply by fitting the protrusion in the notch of the cable. Furthermore, since the cable width is made smaller by the width of one conductor than that of the first lighting apparatus cable, the cable is made lighter in weight. Particularly in case the illumination apparatus becomes longer, it is advantageous to use the second lighting apparatus cable which allows it to reduce the requirement on the place where the lighting apparatus is to be installed.

The second lighting apparatus cable is preferably used for the lighting module provided with a control device that requires one signal conductor.

A first lighting apparatus of the present invention comprises a plurality of lighting modules each including one or more lighting device, a control device that controls the lighting device, a case that houses the lighting device and the control device, and a plurality of electrically conducting terminals that are electrically connected to the control device and penetrate through the case to protrude to the outside of the case; and a flat cable for connecting the lighting modules in such a manner that colors and/or luminous intensities of emitted lights of the lighting modules can be controlled, the flat cable including at least four conductors disposed in parallel which include two signal conductors disposed at both sides of the cable and two power feeding conductors, a sheath member covering the at least four conductors to integrate, and notches formed on both sides of the cable so as to cut the signal conductors, wherein two electrically conducting terminals are pierced to both sides of the notch so that the two electrically conducting terminals and the signal conductors are electrically connected to each other, and the case has protrusions to be fitted in the notches of the cable to support the flat cable.

The first lighting apparatus enables it to easily determine the positions where the lighting modules are to be fastened, by means of the constitution that comprises the cable having the notches, and the case for the lighting module having the protrusion to be fitted in the notch. Since fitting the protrusion in the notch of the cable causes the cable to be held between the protrusions of the lighting module, the cable and the lighting module can be securely fastened to each other temporarily until the lighting modules are fully fastened onto the cable. Also the case for the lighting module that is temporarily fastened does not move or rotate with respect to the cable, and does not incline with respect to the cable surface, during the temporary fastening period. As a result, the electrically conducting terminals can be pierced to the cable at the correct positions thereof. This makes it easier to assemble the lighting modules with the cable, thus increasing the efficiency of manufacturing. It is also made possible to dispose the LEDs at the. predetermined intervals simply by fitting the protrusion in the notch of the cable.

A second lighting apparatus of the present invention comprises a plurality of lighting modules each including one or more lighting device, a control device that controls the lighting device, a case that houses the lighting device and the control device, and a plurality of electrically conducting terminals that are electrically connected to the control device and penetrate through the case to protrude to the outside of the case; and a flat cable for connecting the lighting modules in such a manner that colors and/or luminous intensities of emitted lights of the lighting modules can be controlled, the flat cable including at least three conductors disposed in parallel which include one signal conductor disposed at one side of the cable and two power feeding conductors, a sheath member covering the at least three conductors to integrate, and notch formed on the one side of the cable so as to cut the signal conductor, wherein two electrically conducting terminals are pierced to both sides of the notch so that the two electrically conducting terminals and the signal conductors are electrically connected to each other, and the case has a protrusion to be fitted in the notch of the cable to support the flat cable.

The second lighting apparatus enables it to easily determine the positions where the lighting modules are to be fastened, by the constitution that comprises the cable having the notches, and the case for the lighting module having the protrusion to be fitted in the notch. The cable and the lighting module can be temporarily fastened to each other until the lighting modules are fully fastened onto the cable. This makes it easier to assemble the lighting modules with the cable, thus increasing the efficiency of manufacturing. Also because the cable width is made smaller by the width of one conductor than that of the first lighting apparatus cable, the cable is made lighter in weight. Particularly in case the illumination apparatus becomes longer, it is advantageous to use the second lighting apparatus cable which allows it to reduce the requirement on the place where the lighting apparatus is to be installed. It is also made possible to dispose the LEDs at the predetermined intervals simply by fitting the protrusion in the notch in the cable.

The lighting apparatus cable of the present invention makes it easier to attach the lighting modules to the cable at predetermined intervals. The lighting apparatus cable of the present invention also makes it possible to temporarily attach the lighting modules stably. As a result, use of the lighting apparatus cable of the present invention enables it to improve the productivity of manufacturing the lighting apparatus. The lighting apparatus of the present invention is capable of improving the productivity by using the lighting apparatus cable of the present invention.

DETAILED DESCRIPTION OF THE INVENTION

Figure 1A:
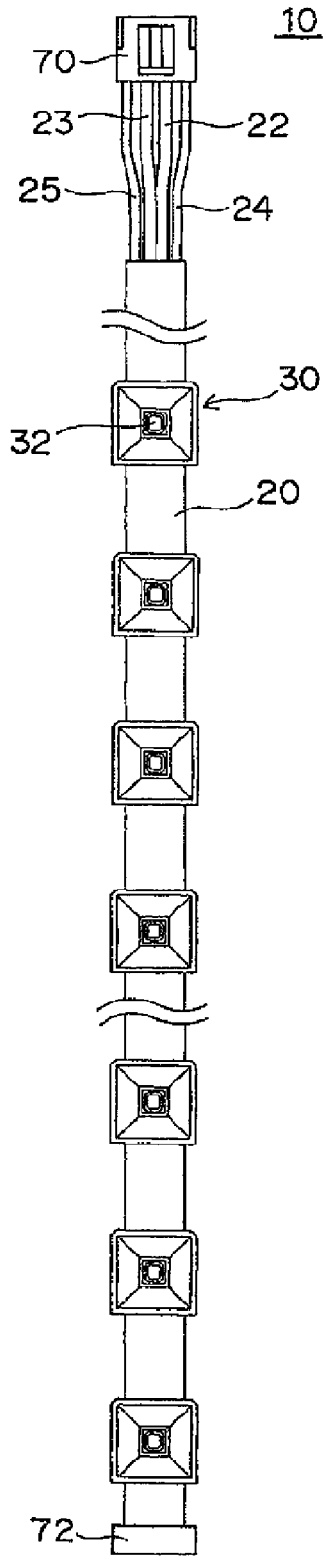
FIG. 1A is a front view of the lighting apparatus according to an embodiment.
Figure 1B:
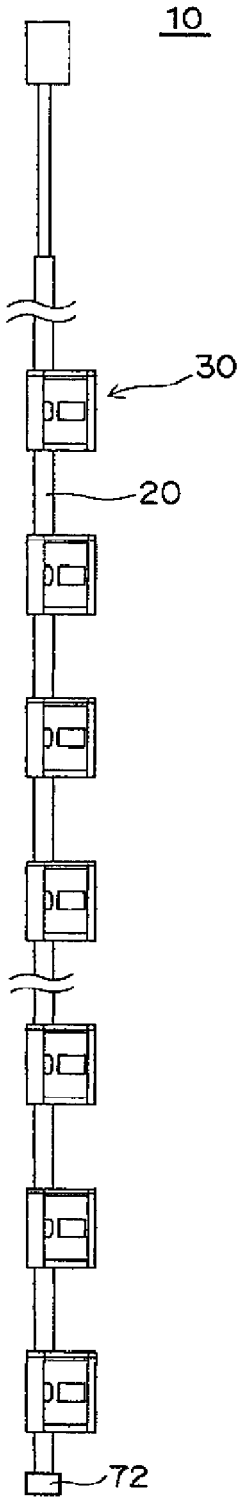
FIG. 1B is a side view of the lighting apparatus according to the embodiment.

In the lighting apparatus 10 shown in FIG. 1A and FIG. 1B, a plurality (7 in the case shown in the drawing) of lighting modules 30 are attached to one lighting apparatus cable 20 in such a manner that light emitting surfaces (surfaces in which the lighting devices 32 are seen) of the lighting modules 30 face in the same direction. The lighting apparatus 10 is wired so that the modules on the pixels are connected in series. The lighting module 30 has the lighting device 32 and the control device (not shown) that controls the lighting device incorporated therein.

The cable 20 is constituted from a flat cable having a flat cross section that is perpendicular to the longitudinal direction. The cable 20 has a plurality of conductors 22 to 25 which are disposed in parallel to each other and a sheath member 28 that integrates the conductors into one piece. The conductors 22 to 25 may be insulated wires covered by insulating covers 29. The insulating covers 29 have different colors to enable it to make sure of correct wiring. The cable 20 has, on one end thereof, a connector for connecting to an external power source. The other end of the cable 20 is terminated with an end cap for the purpose of protecting the terminals.

Figure 2A:
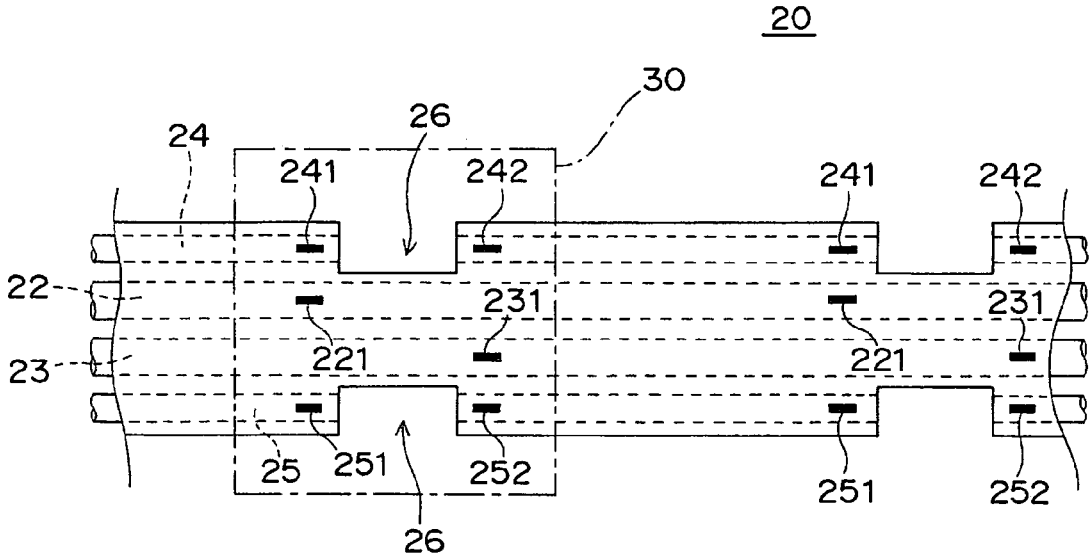
FIG. 2A is a front view of the cable according to the embodiment.
Figure 2B:
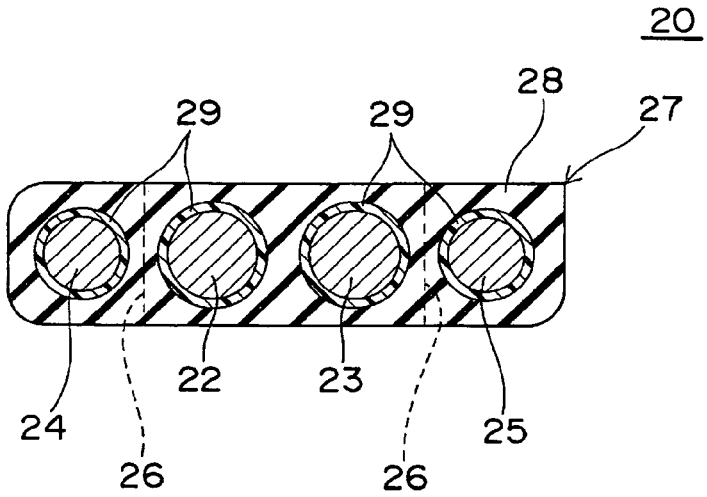
FIG. 2B is a sectional view of the cable according to the embodiment.

As shown in FIG. 2A and FIG. 2B, the cable 20 of this embodiment consists of four conductors in all. Two conductors located inside are power feeding conductors 22, 23, and the conductors located outside of the power feeding conductor 22, 23 are signal conductors 24, 25. The number of the signal conductors 24, 25 determines the type of the control device that can be used. This is because different types of the control device require different numbers of signal conductors. The cable 20 shown in the drawing can serve both a type of control device that requires one signal conductor and a type of control device that requires two signal conductors.

In case light emitting diodes are used as the lighting device 32 of the lighting module 30, DC current is supplied through the power feeding conductors 22, 23. For example, one power feeding conductor 22 is used as a voltage line and the other power feeding conductor 23 is grounded. The two signal conductors 24, 25 can be used to send different electrical signals. For example, one signal conductor 24 can be used to send clock (CK) signal and the other signal conductor 25 can be used to sent digital input (DI) signal.

The cable 20 has a plurality of notches 26 formed on both sides thereof, while the notches 26 cut off the signal conductors 24, 25. As a result, the signal conductor 24, 25 are interrupted at a plurality of points within one cable. The notches 26 are formed in pairs each located on both sides of the cable 20. FIG. 2A shows the pair of notches 26 as formed in the same shape and located at positions opposing each other. However, the pair of notches 26 may be located at positions deviating a little from the opposing positions, and may have different shapes. In either case, it is necessary to form the pair of notches 26 so as to be located within the lighting module 30 when the lighting module 30 is attached to the cable.

The power feeding conductors 22, 23 of the cable 20 must comprise conductors having a high power carrying capacity (conductor of a large diameter) so as to supply power to the lighting device 32 that is provided in the lighting module. The signal conductors 24, 25, in contrast, carry electrical signals sent for controlling the color and/or luminous intensity of emitted light of the lighting module 30, and therefore may comprise conductors having a low power carrying capacity (conductor of a small diameter). According to the present invention, therefore, the signal conductors 24, 25 may be smaller in diameter than the power feeding conductors 22, 23. When the signal conductors 24, 25 are thin wires, it requires smaller force to cut the wires, and therefore it is easier to form the notches 26 in the cable 20.

In the lighting apparatus 10 formed in series connection as in this embodiment, it is necessary that the light emitting surfaces of all the lighting modules face in the same direction. Since the four conductors 22 to 25 of the cable 20 have different functions, incorrect wiring of the lighting module 30 and the cable 20 (for example, confusion of the poles of the power feeding conductor and the poles of the signal conductor) may result in destruction of the lighting module 30. Therefore, it is important to ensure that all the lighting modules 30 face in the same direction with respective to the cable 20. For this reason, it is preferable to form the cable 20 with a cross section that is not axially symmetrical nor point-symmetrical (such a shape will be referred to as asymmetrical shape in this specification), which prohibits it to attach the lighting module 30 in a wrong orientation. Specifically, the cable 20 has a cross section perpendicular to the longitudinal direction thereof that is usually an elongated rectangle or a polygon generated by deforming a rectangle, and therefore there are usually two sets of pair of opposing sides (which may be bending lines). Cross section of the cable 20 may be formed in an asymmetrical shape by differentiating the dimension and/or shape of at least one set of sides (or bending lines) among the two sets. Asymmetrical shape of the cross section makes it possible to uniquely determine the direction of attaching the lighting module 30. As a result, it becomes easy to connect the power feeding conductor and the LEDs while matching the positive electrode and the negative pole correctly.

The cable 20 may have such an asymmetrical cross section as shown in FIG. 2B where, among four apexes of a substantially elongated rectangular shape, only one apex 27 is formed in right angles, and the other three apexes are rounded. In this case, the cross section has such a shape that has two sets of opposing sides (one set of short sides and one set of long sides) where, of the set of short sides, one short side continuing to the apex 27 is curved on one end and is straight on the other end. As a result, the two short sides have different shapes. The two long sides also have different shapes. By differentiating the shape of a part of the opposing sides, the cross section is formed in an asymmetrical shape.

Besides this method, the dimension and/or shape of the opposing sides may be differentiated by another method such as providing a recess or a protrusion in part of a side of the cross section and/or forming in a trapezoidal shape with only one side of the cross section tilted.

FIG. 3 to FIG. 5B show the constitution of the lighting module 30 that can be suitably attached to the cable 20 described above. A case 40 for the lighting module 30 shown in FIG. 3 comprises a main body 41 having the shape of a substantially rectangular bottomed container, a mask 44 secured on the side of an opening (which corresponds to the light emitting surface side of the lighting module 30) of the main body 41 and a cable guide 42 fastened onto the back of the main body 41. The case 40 may further comprise a bar guide 461 fastened onto the back side of the cable guide 42 as required.

Figure 3:
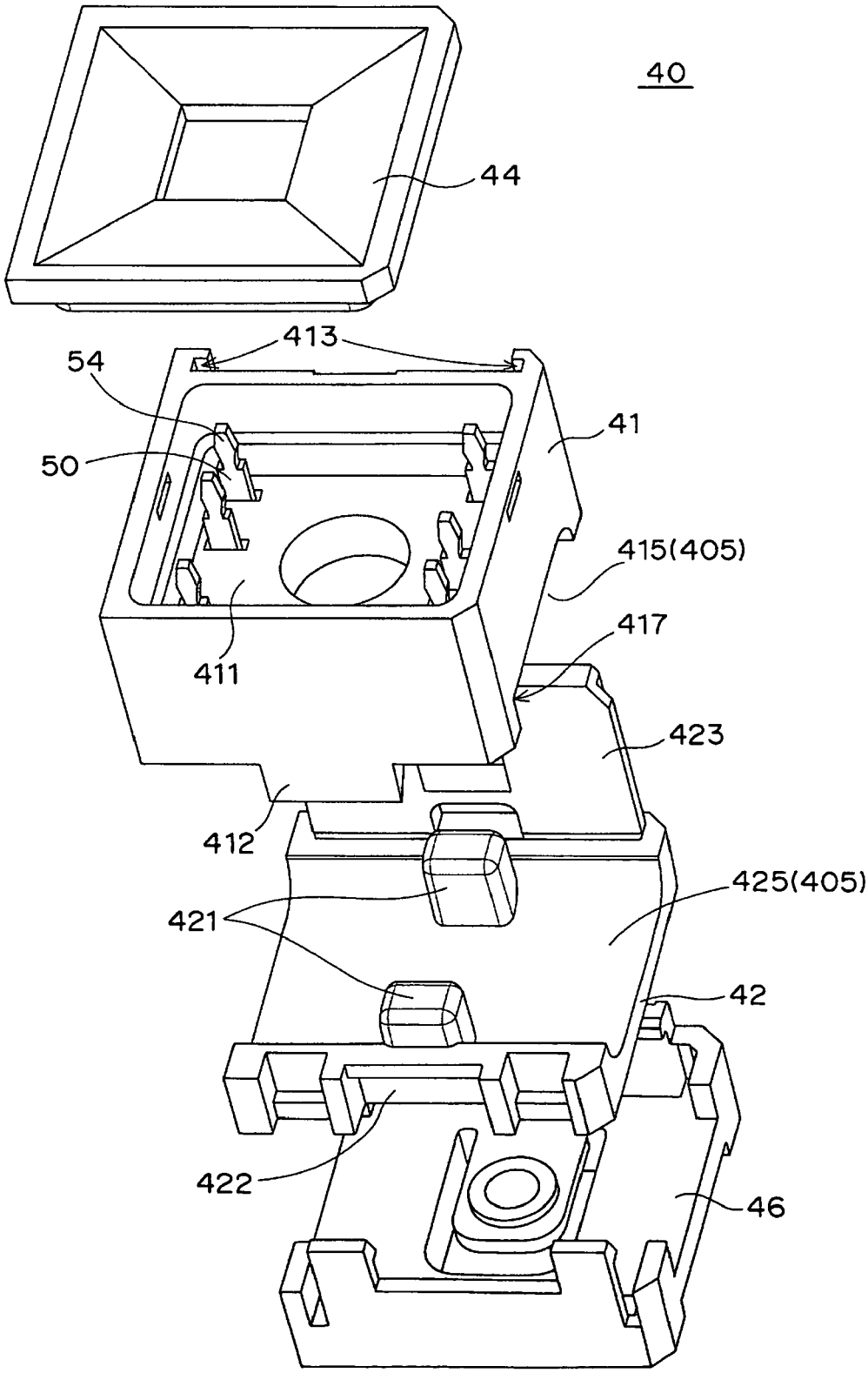
FIG. 3 is an exploded view of the case for the lighting module according to the embodiment.

As shown in FIG. 3, the main body 41 of the case 40 has a partition wall 411 that constitutes the bottom of the bottomed container. The partition wall 411 has a through hole formed at the center thereof, and six electrically conducting terminals 50 are embedded around the through hole. The electrically conducting terminal 50 is a member constituted from a sheet that is longer in one direction, as shown in detail in FIG. 4. The electrically conducting terminal 50 has a sharp distal end 52, a wider intermediate portion and a narrower rear end portion 54. The intermediate portion of the electrically conducting terminal 50 is fastened onto the partition wall 411, while the distal end 52 protrudes out of the main body 41 and the rear end portion 54 protrudes to the inside of the main body 41.

When the case 40 is attached to the cable 20, the distal end portions 52 of the electrically conducting terminal 50 are pierced into the cable 20. At this time, each of the two electrically conducting terminals 50 is pierced into contact with each of the power feeding conductors 22, 23. For example, the two electrically conducting terminals 50 are pierced to a piercing position 221 for the power feeding conductor 22 and at a piercing position 231 for the power feeding conductor 23 (refer to FIG. 2A). The remaining four electrically conducting terminals 50 are pierced to the signal conductors, with two of the electrically conducting terminals for each of the signal conductors 24, 25. The two electrically conducting terminals 50 which are pierced into contact with the signal conductors 24, 25 are pierced to both sides of the notches 26 of the signal conductors 24, 25. For example, two electrically conducting terminals 50 are pierced to piercing positions 241, 242 located on both sides of the notches 26 for the signal conductor 24 (refer to FIG. 2A). And two electrically conducting terminals 50 are pierced to two piercing positions 251, 252 located on both sides of the notches 26 for the other signal conductor 25. According to this embodiment, in this way, the case 40 has the two electrically conducting terminals 50 which are pierced into contact with the power feeding conductors 22, 23, and the four electrically conducting terminals 50 which are pierced into contact with the signal conductors 24, 25, six electrically conducting terminals 50 in all.

The electrically conducting terminals 50 and the conductors 22 to 25 are electrically connected with each other by causing the electrically conducting terminals 50 to penetrate into contact with the power feeding conductors 22, 23 and the signal conductors 24, 25.

According to the method of connecting the electrically conducting terminal 50 to the conductors 22 to 25 of the cable 20 by penetration as described above, it is necessary to strip the cable 20 of the insulating cover before connecting the cable and the electrically conducting terminals, or to solder the conductors and the electrically conducting terminals together. As a result, there is such an advantage that it is made simpler to assemble the lighting apparatus. The fact that the cable 20 and the lighting module 30 are not soldered together provides an advantage when the lighting module 30 is replaced individually. In the lighting apparatus 10 of the present invention, for example, when one or several lighting module 30 among the plurality of lighting modules 30 attached to the lighting apparatus 10 fail, only the failed lighting module 30 can be replaced with new lighting module 30. In case the lighting modules 30 are soldered, the replacement required it to remove the solder. Connection established only by penetration of the electrically conducting terminal 50 as in this embodiment enables it to easily remove the electrically conducting terminal 50.

Figure 4:
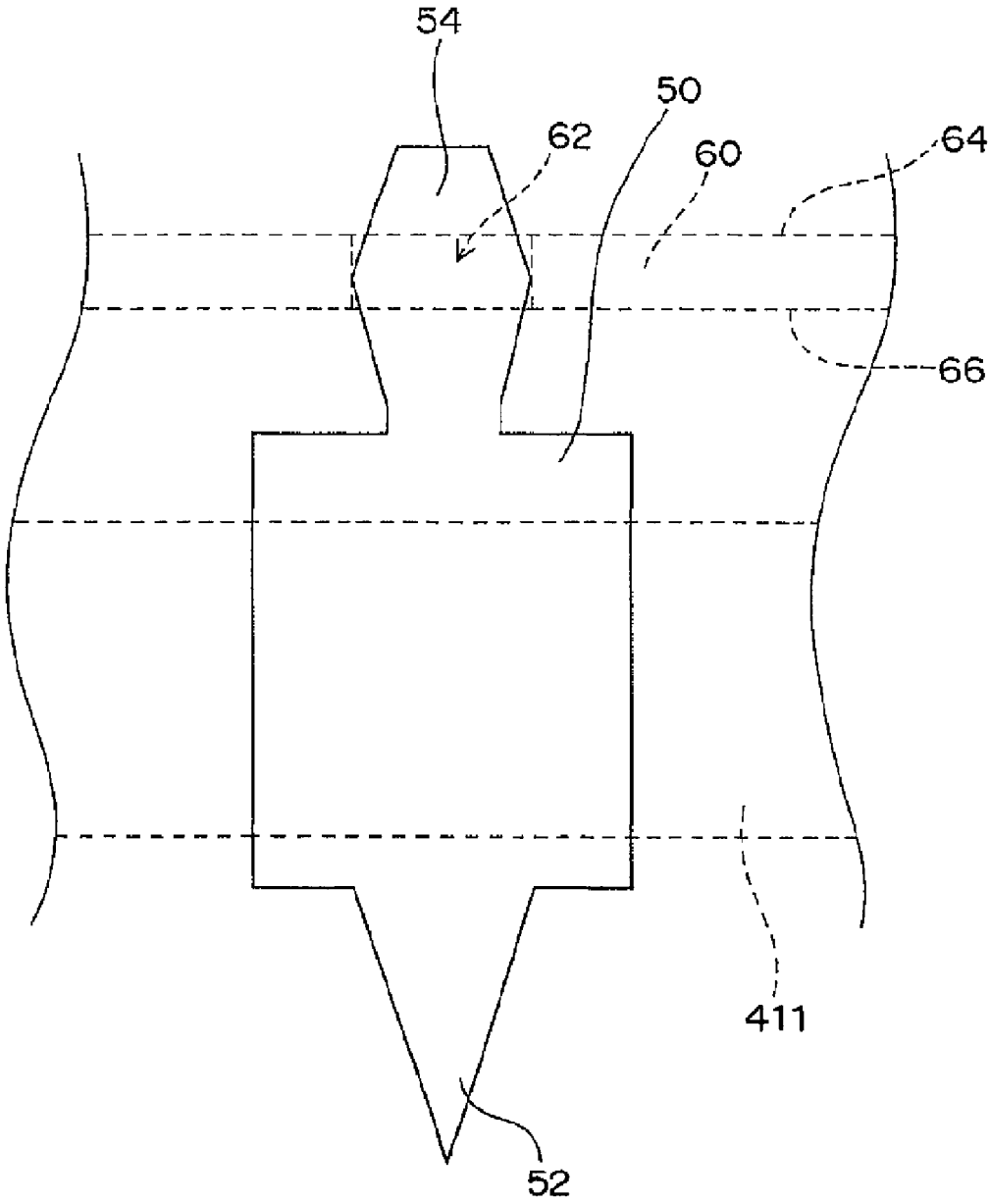
FIG. 4 is a schematic front view of the electrically conducting terminal according to the embodiment.
Figure 5A:
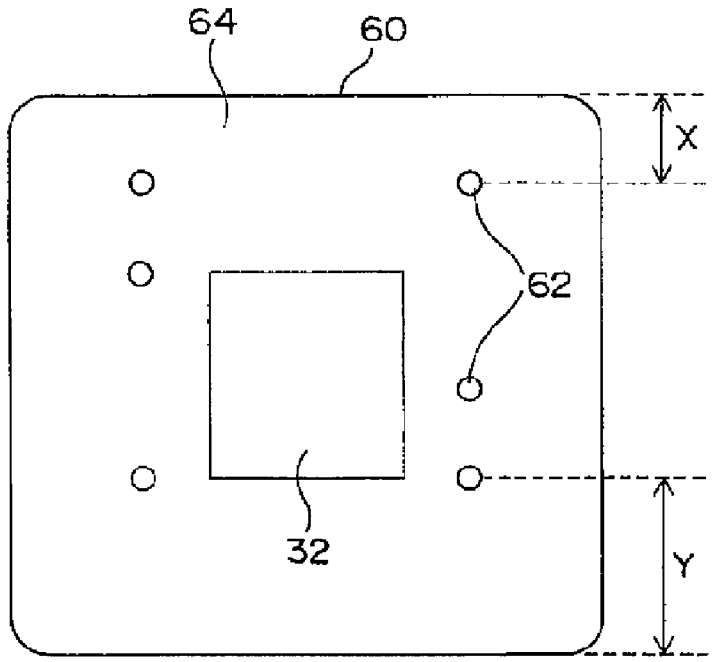
FIG. 5A is a schematic front view of the circuit board for the lighting module according to the embodiment.
Figure 5B:
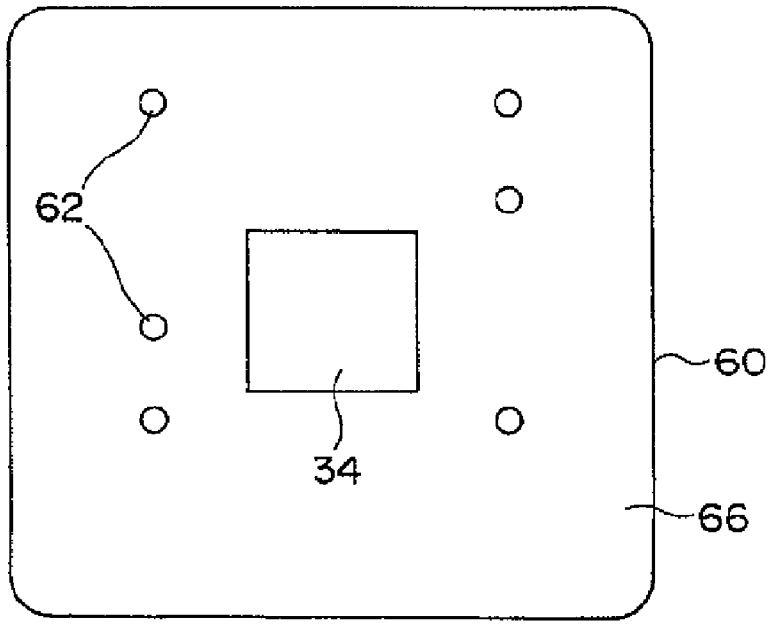
FIG. 5B is a schematic rear view of the circuit board for the lighting module according to the embodiment.

The electrically conducting terminal 50 shown in FIG. 4 is provided with a circuit board 60 shown in FIG. 5A and FIG. 5B installed on the rear end portion 54 thereof. The circuit board 60 has circuits (not shown) printed on both sides thereof, while the lighting device 32 is mounted on a light emitting surface 64 and the control device 34 is mounted on the back surface 66. The circuit board 66 also has through holes 62 that are used in electrical connection with the cable 20. According to the present invention, the circuit board 60 and the electrically conducting terminal 50 can be connected together and the electrically conducting terminal 50 can be fastened onto the circuit board 60 without using a solder or an electrically conductive adhesive, by forcing the rear end portions 54 of the electrically conducting terminal 50 into the through holes 62 (refer to FIG. 4).

The through holes 62 are formed in the circuit board 60 at positions corresponding to the rear end portions 54 of the electrically conducting terminals 50, in order to make it possible to fasten the electrically conducting terminals 50 onto the circuit board 60 by forcing the rear end portions 54 of the electrically conducting terminal 50 into the through holes 62 of the circuit board 60. At this time, it is preferable that two opposing edges of the circuit board 60 are at different distances (distance X and distance Y in the drawing) from the nearest through hole 62, as shown in FIG. 5A. This makes it possible to prevent a mistake from occurring in connecting the circuit board 60 and the electrically conducting terminal 50 to each other. For example, when attention is given only to the through holes 62 shown in FIG. 5A and FIG. 5B, the six through holes 62 are disposed in a point-symmetric arrangement. When distance X and distance Y are the same, the circuit board 60 can be connected to the electrically conducting terminals 50 in either the predetermined orientation or in an orientation reversed by 180 degrees. However, since the lighting device 32 and the control device 34 mounted on the circuit board 60 have positive and negative poles, connecting the circuit board 60 to the electrically conducting terminals 50 in the orientation reversed by 180 degrees results in a defective product. It is highly probable that supplying power to a defective product leads to destruction of the lighting device 32 and/or the control device 34. Accordingly, the through holes 62 are formed in the circuit board 60 in such an arrangement that inversion of the circuit board 60 to an axially symmetrical position or a point-symmetrical position results in an arrangement of the through holes 62 different from the correct arrangement. This enables it to correctly connect the circuit board 60.

Now by making reference again to FIG. 3, the case 40 can hold the cable 20 between the main body 41 and the cable guide 42 that is fastened onto the back of the main body 41. The cable guide 42 has a cable receiving recess 425 that matches the profile of the cable 20. The main body 41 also has a cable receiving recess 415 formed on the back surface thereof. When the case 40 is assembled, the two cable receiving recesses 415, 425 form a through hole (which will be referred to as cable receiving section 405) that matches the cross sectional shape of the cable 20. Accordingly, the cable 20 can be held in the cable receiving section 405 by assembling the case 40 after placing the cable 20 between the two cable receiving recesses 415, 425 (refer to FIG. 6 and FIG. 7).

Figure 6:
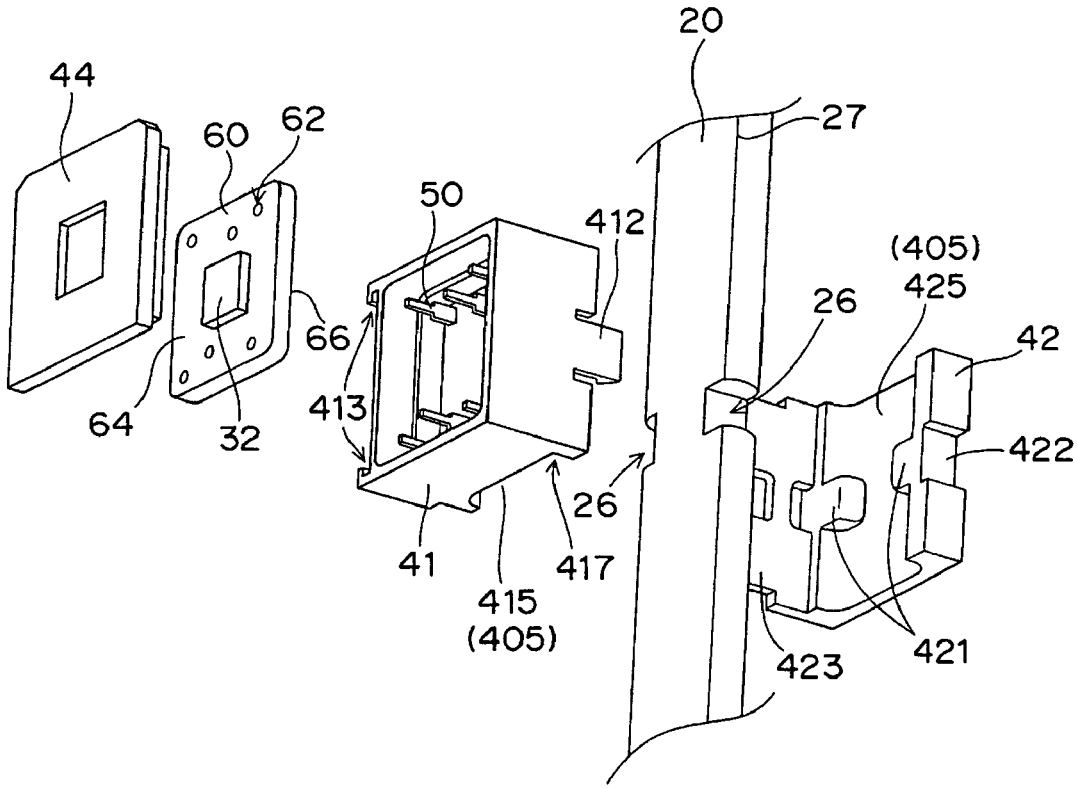
FIG. 6 is an exploded view of the lighting apparatus according to the embodiment.
Figure 7:
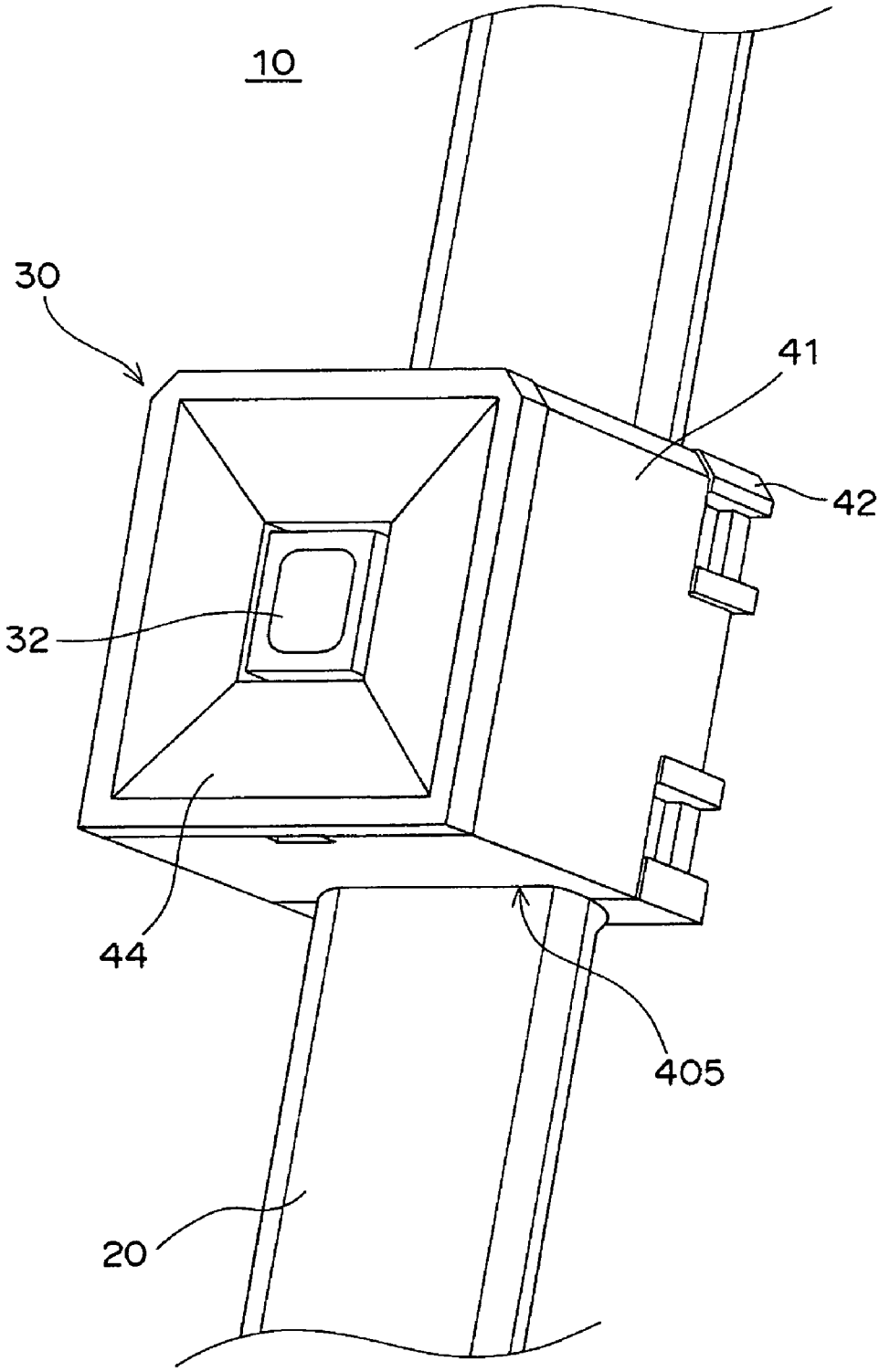
FIG. 7 is a partially enlarged perspective view of the lighting apparatus according to the embodiment.

As shown in FIG. 3 and FIG. 6, the cable guide 42 has two protrusions 421 formed on the inside of the cable receiving recess 425 for fitting into the notch 26 of the cable 20. To hold the cable 20 in the cable receiving section 405, first, the cable 20 is put into contact with the cable guide 42, the protrusion 421 of the cable 42 is fitted into the notch 26 of the cable 20, and the main body 41 and the cable guide 42 are assembled. In case the notches 26 are formed at predetermined intervals in the cable 20, the plurality of lighting modules can be easily fastened at the predetermined intervals by attaching the lighting modules 30 at positions that correspond to the notches 26.

In this embodiment, a pair of notches 26 is formed on both sides of the cable 20. When a pair of protrusions 421 is fitted into the pair of notches 26, the protrusions 421 hold the cable 20 on both sides. This achieves temporary fastening of the cable guide 421 on the cable 20. Thus the cable guide 42 can be fastened at predetermined position of the cable 20 temporarily, without moving in the longitudinal direction or in the lateral direction until the lighting modules 30 are fully assembled.

Now comparison will be made between the method of temporary fastening of the cable guide 42 described above and the method of positioning where the locating pins are to be inserted into the through holes according to U.S. Pat. No. 6,777,891. The method described in U.S. Pat. No. 6,777,891 has three problems: (1) possibility of the lighting module to rotate around the through hole; (2) possibility of the locating pins to tilt when inserting the locating pins into the through holes that penetrate the cable in the direction of thickness; and (3) the locating pins may swing within the through holes. These three problems are all solved in this embodiment by combining the notch 26 of the cable 20 and the protrusion 421.

Moreover, supporting the cable guide 42 on the cable 20 by using the protrusions 421 and the notches 26 not only provides advantage in the temporary fastening but also serves as a retainer that prevents the cable 20 from coming off after fastening the case 40 on the cable 20 by holding the cable 20 between the main body 41 and the cable guide 42. The methods described in Published Japanese Translation No. 2005-515481 of the PCT Application and Japanese Unexamined Patent Publication (Kokai) No. 2004-103383 have the problem that the electrically conducting terminal may receive a stress that deforms or damages the electrically conducting terminal, resulting in contact failure of the lighting module 30, when such a force is applied that would pull the cable 20 from the lighting module. In this embodiment, the stress is absorbed between the notch 26 in the cable 20 and the protrusion 421 of the cable guide 42, and therefore the electrically conducting terminals 50 are less likely to be affected by the stress. As a result, the problem of deformation or damage of the electrically conducting terminals 50 is eliminated.

It is preferable to form the cable receiving section 405 of the case 40 with the same cross sectional shape as that of the cable 20, which improves the reliability of holding effect of the cable 20 by the cable receiving section 405. In case the cable 20 has an asymmetrical cross section as described previously, it is preferable that the cable receiving section 405 also has an asymmetrical cross section. For example, if the cable 20 has a cross section of elongated rectangle with only one apex 27 being right-angled as shown in FIG. 2B, the cable receiving section 405 is also formed with a right-angled corner. FIG. 3 and FIG. 6 show the cable receiving recess 415 of the main body 41 with one corner 417 being right-angled. Use of the case 40 having such a configuration enables it to attach the case 40 always in the correct orientation on the cable 20.

Modification

Figure 8A:
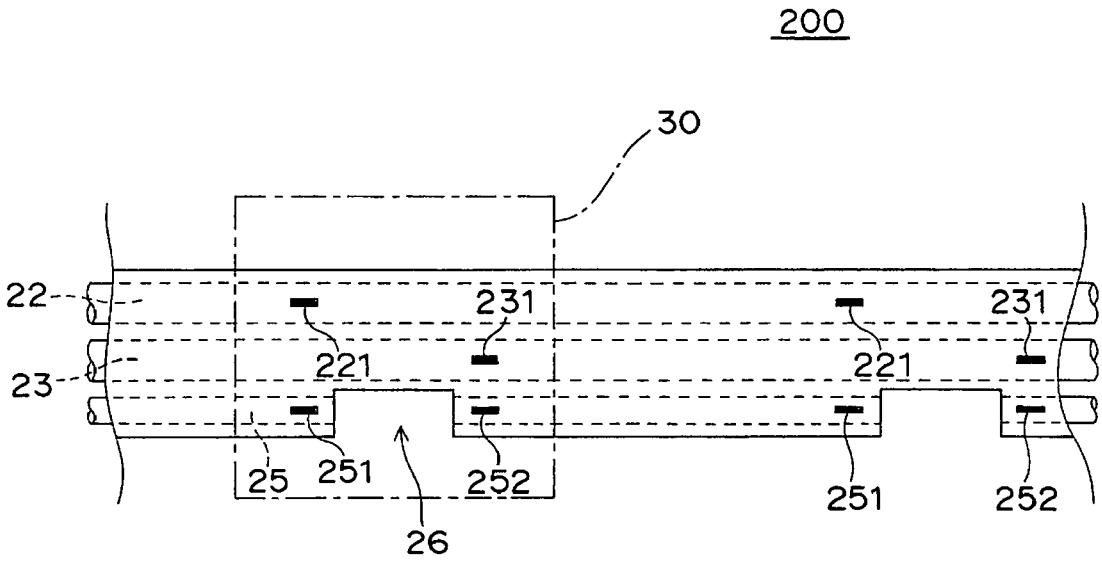
FIG. 8A is a front view of the cable according to a variation of the embodiment.
Figure 8B:
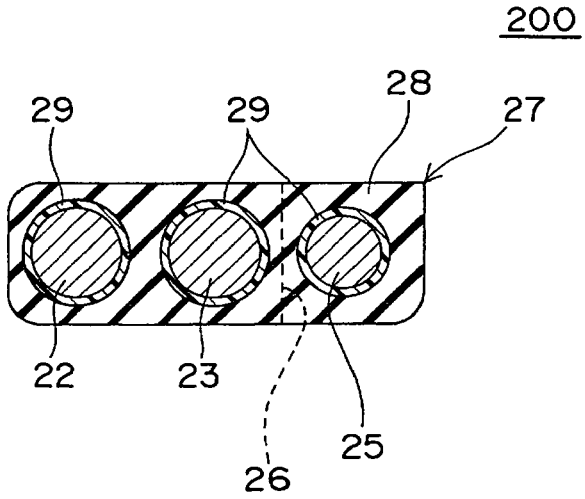
FIG. 8B is a sectional view of the cable according to the variation of the embodiment.

In case the control device 34 used in the lighting module is of such a type that requires only one signal conductor, a cable 200 that has only one signal conductor 25 as shown in FIG. 8A and FIG. 8B can be used. Since the cable 200 shown in FIG. 8A and FIG. 8B has a cross sectional area smaller than that of the cable 20 shown in FIG. 2A and FIG. 2B, cable weight per unit length can be decreased. As a result, use of the cable 200 enables it to manufacture the lighting apparatus 10 of larger length with the same weight as the cable 20, or manufacture the lighting apparatus 10 of less weight with the same length as the cable 20.

As shown in FIG. 8A and FIG. 8B, the cable 200 of the Variation has three conductors in all. Two conductors which adjoin each other are the power feeding conductors 22, 23, and one conductor disposed on the outside of the power feeding conductor 23 is the signal conductor 25.

A plurality of notches 26 is formed on one side (the side where the signal conductor 25 is disposed) of the cable 200, and the notches 26 cut off the signal conductor 25. As a result, the signal conductor 25 is cut at a plurality of points within one cable. It is necessary to form the notches 26 so as to be located within the lighting module 30 when the lighting module is attached to the cable 26.

The cable 200 may be combined with the lighting module 30, similarly to the cable 20 shown in FIG. 2A, to form the lighting apparatus 10. However, the cable 200 has the notches 26 only on one side thereof. Therefore, it is preferable to modify the two protrusions 421 of the cable guide 42 shown in FIG. 3 and FIG. 6 so as to match with the notches 26 of the cable 20 (that is, to reduce the number of the protrusions 421 to one).

The cable 200 of the Variation also enables it to easily position the lighting modules 30 by fitting the protrusions 421 into the notches 26.

Temporary fastening of the cable guide 42 on the cable 200 can be achieved relatively stably even when the protrusion 421 is fitted into the notch 26 only at one point, by forming the cable receiving recess 425 in the cable guide 42 in such a shape that matches the profile of the cable 200. Thus the cable guide 42 can be fastened at a predetermined position of the cable 200 temporarily, without moving in the longitudinal direction or in the lateral direction until the lighting modules 30 are fully assembled.

When the case 40 is attached to the cable 200, the distal end portions 52 of the electrically conducting terminals 50 are pierced into the cable 200. At this time, each of the two electrically conducting terminals 50 is pierced into contact with each of the power feeding conductors 22, 23. For example, the two electrically conducting terminals 50 are pierced to a piercing position 221 for the power feeding conductor 22 and at a piercing position 231 for the power feeding conductor 23 (refer to FIG. 8A). Two electrically conducting terminals 50 are pierced into contact with the signal conductor 25. The two electrically conducting terminals 50 which are pierced into contact with the signal conductor 25 are pierced to both sides of the notch 26 of the signal conductor 25. For example, two electrically conducting terminals 50 are pierced to piercing positions 251, 252 located on both sides of the notch 26 (refer to FIG. 8A).

In total, four electrically conducting terminals 50 are pierced into the cable 200. Accordingly, number of the electrically conducting terminals 50 fastened onto the partition wall 411 (refer to FIG. 3 and FIG. 6) of the main body 41 of the case 40 of the lighting module 30 would be changed from 6 to 4.

Number of the through holes 62 of the circuit board 60 shown in FIG. 5A, FIG. 5B and FIG. 6 may be changed from 6 to 4. Alternatively, the circuit board 60 having six through holes 62 may be employed, while using four through holes with two through holes left unused.

While the lighting apparatus 10 uses the cable 20 or the cable 200 in this embodiment, either of the lighting apparatuses may be used in various applications shown in FIG. 9A to FIG. 9E.

Figure 9A:
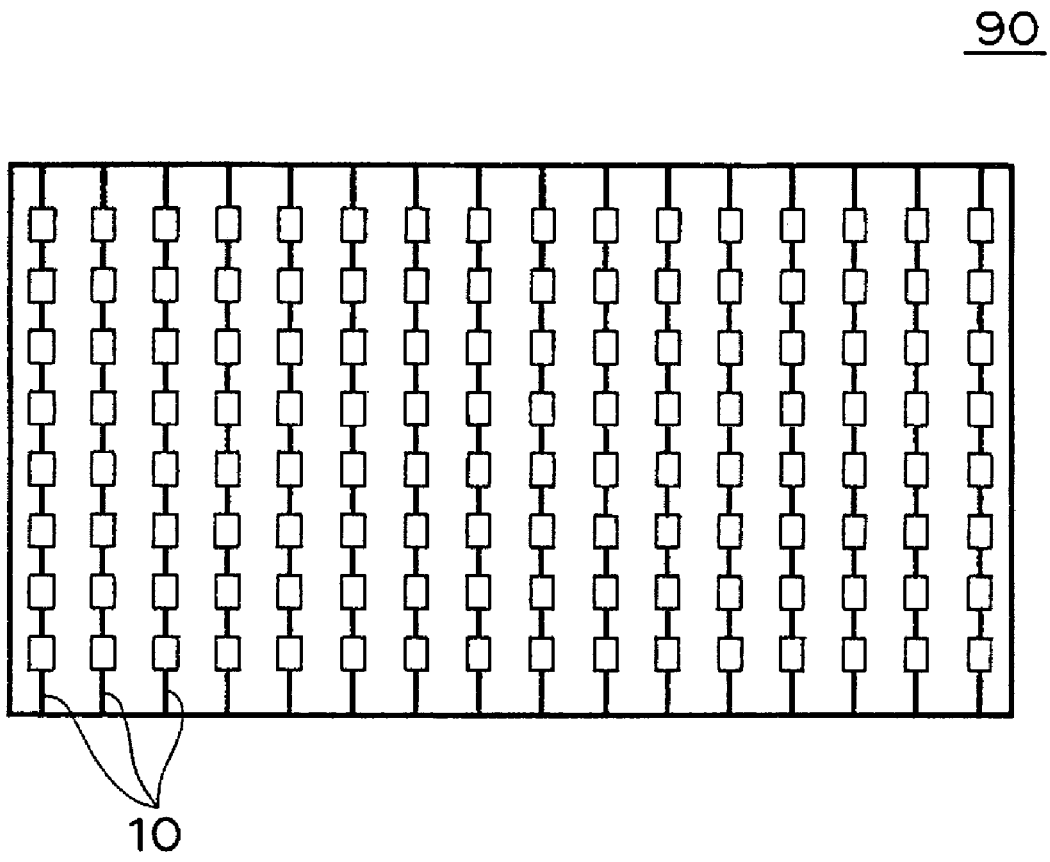
FIG. 9A is a schematic diagram of a display using the lighting apparatus of the present invention.

FIG. 9A shows a fixed block where an upper end and a lower end of the lighting apparatus 10 of straight configuration are fixed on a frame or the like, that can be used as, for example, a small-depth display.

Figure 9B:
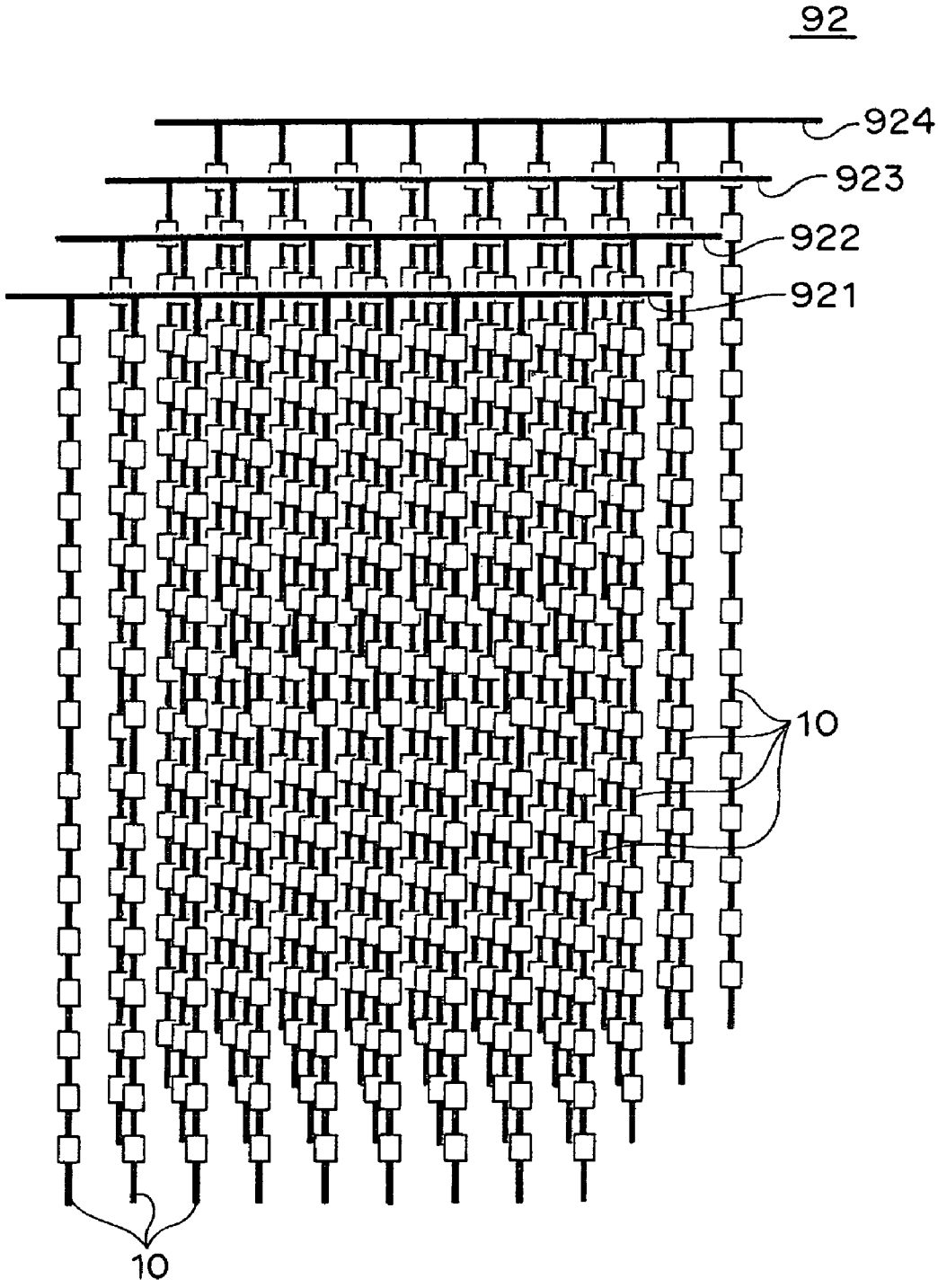
FIG. 9B is a schematic diagram of a 3-dimensional display using the lighting apparatus of the present invention.

FIG. 9B shows a 3-dimensional display having a significant depth. A plurality of bamboo-blind-like displays 921 to 924 are formed by suspending a plurality of lighting apparatuses 10 from a bar held which is in a horizontal position. The plurality of bamboo-blind-like displays 921 to 924 are disposed in parallel to each other so as to form the 3-dimensional display.

In the applications shown in FIG. 9A and FIG. 9B, it is preferable that all the lighting modules 30 are oriented always in a predetermined direction. For this reason, it is desirable that the cable 20 (and the cable 200) is rigid, or flexible but relatively resistant to twisting.

Figure 9C:
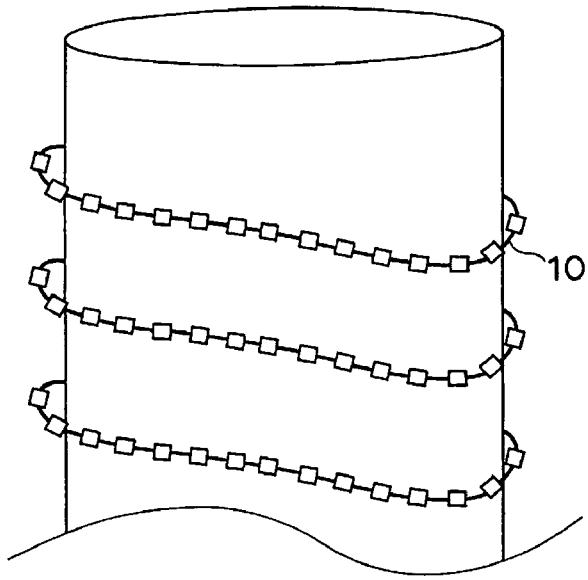
FIG. 9C is a schematic diagram showing a mode of using the lighting apparatus of the present invention.
Figure 9D:
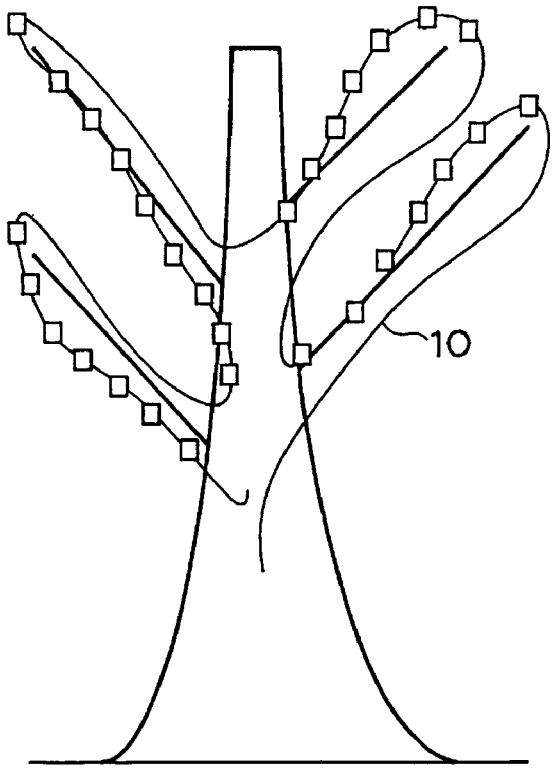
FIG. 9D is a schematic diagram showing a mode of using the lighting apparatus of the present invention.

FIG. 9C shows the lighting apparatus 10 wound around a cylindrical object. FIG. 9D shows the lighting apparatus 10 attached to a tree. In the applications shown in FIG. 9C and FIG. 9D, it is preferable that the cable 20 (and the cable 200) is flexible since the lighting apparatus 10 must bend along the exterior of the structure.

Figure 9E:
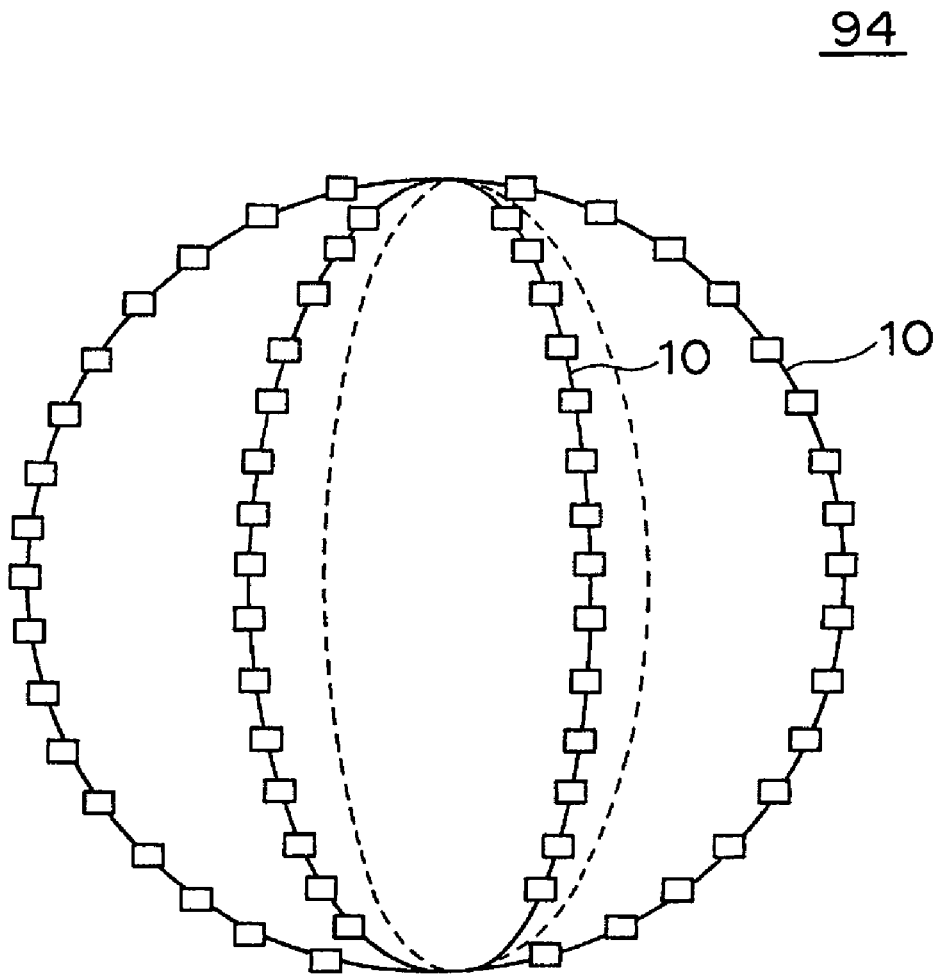
FIG. 9E is a schematic diagram showing an illumination object using the lighting apparatus of the present invention.
Figure 10:
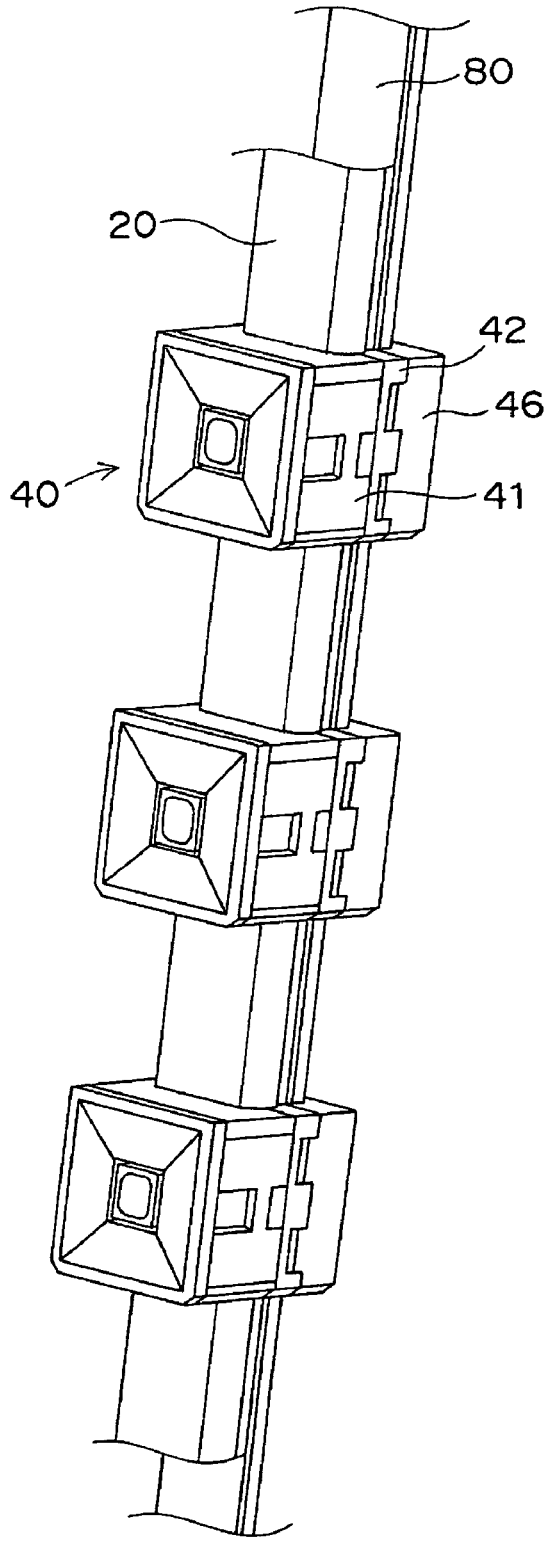
FIG. 10 is a partially enlarged perspective view of the lighting apparatus according to the embodiment.

FIG. 9E shows a spherical illuminated object 94 constituted from a plurality of the lighting apparatuses 10 that are formed in semi-circular shape and are connected to each other. When it is difficult to maintain the predetermined shape for the lighting apparatus 10 by themselves as in the object 94, it is preferable to use a belt-like support for the lighting apparatus 10. FIG. 10 shows an example where a rigid flat bar 80 is attached to the back of the lighting apparatus 10. The flat bar 80 may be fastened onto the back of the lighting module 30 by using such a bar guide 461 as shown in FIG. 3. Since the lighting apparatus 10 having this constitution can be fastened onto the flat bar 80 at a plurality of positions, it is made possible to easily manufacture the illuminated object disposed along the flat bar 80. The bar guide 46 is concealed behind the lighting module 30, and therefore the illuminated object 94 can be formed with neat appearance.

According to the present invention, when some of the lighting modules 30 is damaged during use, only the damaged lighting module 30 can be replaced with a new one. The damaged lighting module 30 can be removed from the cable 20 by breaking the case 40, and the new lighting module 30 can be easily attached at the same position. Thus the lighting apparatus can be repaired in the state of the lighting block shown in FIG. 9A. Also because it is less expensive to replace the lighting module 30 than replacing the entire lighting apparatus 10, maintenance cost can be kept low. When the lighting module 30 is attached to the cable 20, the electrically conducting terminals 50 are pierced to the piercing positions of the cable 20 where electrically conducting terminals 50 of the removed lighting module have been piercing. However, use of a viscoelastic material for the sheath member 28 causes the holes formed by the previous penetration to close after removing the electrically conducting terminal 50, the cable 20 can endure repetitive penetrations.

A procedure of assembling the components of the lighting apparatus 10 will now be described with reference to FIG. 6. The cable 20 dealt with in this assembling procedure is interchangeable with the cable 200.

Step 1

The cable guide 42 is put into contact with the cable 20 near the notch 26. The cable receiving recess 425 is aligned with the longitudinal direction of the cable 20, then the protrusion 421 is fitted into the notch 26 of the cable 20. This enables it to temporarily fasten the lighting module 30 at the predetermined position of the cable 20.

Step 2

A slidable plate 423 of the cable guide 42 is inserted while sliding into a rail groove 413 of the main body 41 of the case 40, so as to cause the main body 41 to approach the cable 20. Since the distal end portions 52 of the six electrically conducting terminals 50 protrude on the back of the main body 41, the distal end portions 52 are pierced into the cable 20 by pressing the main body 41 toward the cable 20. At this time, since the cable guide 42 is temporarily fastened onto the cable 20, the distal end portions 52 and the conductors 22 to 25 disposed in the cable 20 are in particular positional relationship (refer to FIG. 2A). Also because the cable guide 42 is temporarily fastened onto the cable 20, positional relationship between the main body 41 and the cable 20 does not change when the main body 41 is pressed. Therefore, it is not necessary to pay attention to the positions of the electrically conducting terminals 50 relative to the cable 20 when fastening, so that the plurality of electrically conducting terminals 50 can be pierced easily to the optimum positions.

When the electrically conducting terminals 50 are pierced to a predetermined depth in the cable 20, the main body 41 and the cable guide 42 come into contact with each other so as to hold the cable 20 on both sides thereof. At this time, an engagement hook 412 of the main body 41 engages in an engagement recess 422 of the cable guide 42, so that the main body 41 of the case 40 is fastened onto the cable 20.

Step 3

The circuit board 60 is inserted into the main body 41 through the light emitting surface of the main body 41 of the case 40. When inserting the circuit board, orientation of the circuit board 60 is determined so that the back side 66 of the circuit board 60 opposes the main body 41, and the through holes 62 formed in the circuit board 60 match the positions of the rear ends 54 of the electrically conducting terminals 50. The rear end portions 54 of the electrically conducting terminals 50 are inserted into the through holes 62 by pressing the circuit board 60 onto the electrically conducting terminals 50. The circuit board 60 is electrically connected to the electrically conducting terminals 50 via the through holes 62, and is fastened.

Step 4

The mask 44 is fastened on the light emitting surface of the main body 41 of the case 40. The mask 44 can function as a reflector. The mask 44 can also be caused to function as a control device to control the direction of light emission by incorporating a lens, prism, etc. in the mask 44.

The lighting apparatus 10 of the present invention is made by repeating the steps 1 to 4 by the number of the lighting modules 30 to be attached to the cable 20.

The constitutions of the components will now be described.

Cable 20

The power feeding conductors 22, 23 and the signal conductors 24, 25 used in the cable 20 may be formed by twisting tin-plated soft copper wires. Heat-resistant vinyl or the like may be used for the insulating cover 29 of the conductors. The conductors 22 to 25 may be insulated wires covered by insulating covers 29 which have different colors to distinguish the conductors of different functions.

The sheath member 28 preferably has high weatherability and high strength. Particularly, thermoplastic elastomers (TPE), ethylene propylene diene methylene linkage (EPDM) or the like may be preferably used. The cable 20 may be integrated with the sheath member 28 by co-extrusion or the like.

Case 40

The main body 41 of the case 40, the cable guide 42, the mask 44 and the bar guide 46 may be made from a thermoplastic resin that has heat resistance or weatherability such as polycarbonate (PC), ABS resin or the like by injection molding method. The main body 41 may be manufactured by placing the electrically conducting terminals 50 at the position of the partition wall 411 in a die used in injection molding, by injecting the material into the die and molding. This method enables it to embed the electrically conducting terminals 50 in the partition wall 411 at the same time as the main body 41 is molded, and to securely fasten the electrically conducting terminal 50 to the partition wall 411.

These components are preferably black when used for the use as display, which can be achieved by mixing the common carbon black in the resin material. It is preferable to give such colors that match the background color when used for the use as illumination.

Electrically Conducting Terminals 50

The electrically conducting terminals 50 are made by punching through a copper sheet by using a press and die. The distal end portions 52 are sharpened so as to be capable of piercing the sheath member 28 and the insulating cover 29 of the cable 20. The rear end portions 54 are formed in such a shape as the width increases gradually from the rear end 54 toward the distal end 52 so that the through holes 62 of the circuit board 60 can be inserted with pressure. An intermediate portion of the electrically conducting terminal 50 is embedded in the partition wall 411 of the main body 41 of the case 40, thereby fastening the electrically conducting terminal 50 to the main body 41. In order to increase the force of this fastening joint, the intermediate portion of the electrically conducting terminal 50 is made wider than the distal ends 52 and the rear end portions 54 so as to have a larger surface area.

Lighting Device 62

The lighting device 62 may be constituted of, for example, light emitting diodes (LED). The lighting apparatus 10 capable of producing multiple colors can be made by incorporate three LEDs, that emit light of the three primary colors of red, green and blue, in one lighting module 30. Intensities of light emitted by the three LEDs can be individually controlled by means of the control device 34, and therefore light of various colors can be produced by blending the light of the three primary colors. Various lighting modules 30 of one lighting apparatus 10 can also be caused to emit light of different colors, for the application to display.

Control Device 34

An integrated circuit (IC) can be used as the control device. The control devices 34 incorporated in the lighting modules 30 are connected in series with each other by signal conductors 24, 25 that are cut off. With different addresses allocated to the control devices 34, different commands can be sent to the different control devices 34 in a single transmission of signals via the signal conductors 24, 25. Such an operation enables it to cause the various lighting modules 30 to emit light of different colors.

The lighting apparatus 10 of the present invention can be used individually as an illumination, and also can be combined in plurality for the use as a surface emitting display.

What is claimed is:

1. A lighting apparatus comprising:

a plurality of lighting modules each including one or more lighting device, a control device that controls the lighting device, a circuit board on which the lighting device and the control device are mounted, a case including a main body that houses the lighting device, the control device and a circuit board, and a plurality of electrically conducting terminals that are electrically connected to the control device and penetrate through the main body of the case to protrude to the outside of the main body of the case; and a flat cable for connecting the lighting modules in such a manner that colors and/or luminous intensities of emitted lights of the lighting modules can be controlled, the flat cable including at least four conductors disposed in parallel which include two signal conductors disposed at both sides of the cable and two power feeding conductors, a sheath member covering the at least four conductors to integrate, and notches formed on both sides of the cable so as to cut the signal conductors, wherein two electrically conducting terminals are pierced to both sides of the notch so that the two electrically conducting terminals and the signal conductors are electrically connected to each other, and the case has protrusions to be fitted in the notches of the cable to support the flat cable, wherein the circuit board has through holes, and the electrically conducting terminals are inserted into the through holes by pressing so as to electrically connect and fix the circuit board to the electrically conducting terminals.

2. The lighting apparatus according to claim 1, wherein at least one electrically conducting terminal is pierced to each of the power feeding conductors so that the electrically conducting terminal and the power feeding conductor are electrically connected to each other.

3. The lighting apparatus according to claim 1, wherein a cross section of the cable perpendicular to the longitudinal direction of the cable has a set of opposing sides which have different dimensions and/or different shapes.

4. The lighting apparatus according to claim 1, wherein the electrically conducting terminal has an intermediate portion embedded in the main body of the case, a distal end portions to be pierced into the cable and a rear end portions to be inserted into the through holes of the circuit board by pressing, wherein the distal end portion is sharpened, and the rear end portion has an expanded part to be fit in the through hole.

5. The lighting apparatus according to claim 4, wherein the intermediate portion is made wider than the distal end and the rear end portion.

6. The lighting apparatus according to claim 1, wherein the case further includes a cable guide fastened onto the back of the main body of the case, the cable guide having the protrusions and a slidable plate, wherein the main body of the case has a rail groove into which the slidable plate is inserted, and a distal end portion of the electrically conducting terminal protrudes on the back of the main body, wherein the cable is held between the main body and the cable guide.

7. The lighting apparatus according to claim 1, further comprising a mask secured on a light emitting surface side of the main body of the case.

8. The lighting apparatus according to claim 1, wherein the through holes are arranged so that the arrangement thereof is not an axially symmetrical arrangement nor a point-symmetrical arrangement.

9. The lighting apparatus according to claim 1, wherein the lighting device is mounted on a light emitting surface of the circuit board, and the control device is mounted on a back surface of the circuit board.

10. A lighting apparatus comprising:

a plurality of lighting modules each including one or more lighting device, a control device that controls the lighting device, a circuit board on which the lighting device and the control device are mounted, a case including a main body that houses the lighting device, the control device and a circuit board, and a plurality of electrically conducting terminals that are electrically connected to the control device and penetrate through the main body of the case to protrude to the outside of the main body of the case; and a flat cable for connecting the lighting modules in such a manner that colors and/or luminous intensities of emitted lights of the lighting modules can be controlled, the flat cable including at least three conductors disposed in parallel which include one signal conductor disposed at one side of the cable and two power feeding conductors, a sheath member covering the at least three conductors to integrate, and notch formed on the one side of the cable so as to cut the signal conductor, wherein two electrically conducting terminals are pierced to both sides of the notch so that the two electrically conducting terminals and the signal conductors are electrically connected to each other, and the case has a protrusion to be fitted in the notch of the cable to support the flat cable, wherein the circuit board has through holes, and the electrically conducting terminals are inserted into the through holes by pressing so as to electrically connect and fix the circuit board to the electrically conducting terminals.

11. The lighting apparatus according to claim 10, wherein the lighting device is mounted on a light emitting surface of the circuit board, and the control device is mounted on a back surface of the circuit board.

12. The lighting apparatus according to claim 10, further comprising a mask secured on a light emitting surface side of the main body of the case.

13. The lighting apparatus according to claim 10, wherein the through holes are arranged so that the arrangement thereof is not an axially symmetrical arrangement nor a point-symmetrical arrangement.

14. The lighting apparatus according to claim 10, wherein at least one electrically conducting terminal is pierced to each of the power feeding conductors so that the electrically conducting terminal and the power feeding conductor are electrically connected to each other.

15. The lighting apparatus according to claim 10, wherein a cross section of the cable perpendicular to the longitudinal direction of the cable has a set of opposing sides which have different dimensions and/or different shapes.

16. The lighting apparatus according to claim 10, wherein the electrically conducting terminal has an intermediate portion embedded in the main body of the case, a distal end portions to be pierced into the cable and a rear end portions to be inserted into the through holes of the circuit board by pressing, wherein the distal end portion is sharpened, and the rear end portion has an expanded part to be fit in the though hole.

17. The lighting apparatus according to claim 16, wherein the intermediate portion is made wider than the distal end and the rear end portion.

18. The lighting apparatus according to claim 10, wherein the case further includes a cable guide fastened onto the back of the main body of the case, the cable guide having the protrusion and a slidable plate, wherein the main body of the case has a rail groove into which the slidable plate is inserted, and a distal end portion of the electrically conducting terminal protrudes on the back of the main body, wherein the cable is held between the main body and the cable guide.

19. A lighting apparatus comprising:

a plurality of lighting modules each including one or more lighting device, a control device that controls the lighting device, a circuit board on which the lighting device and the control device are mounted and which has through holes, a case including a main body that houses the lighting device, the control device and a circuit board, and a plurality of electrically conducting terminals that are electrically connected to the control device via the though holes, penetrate through the main body of the case to protrude to the outside of the main body of the case and are pierced into the cable; and a flat cable for connecting the lighting modules in such a manner that colors and/or luminous intensities of emitted lights of the lighting modules can be controlled, wherein the electrically conducting terminals are inserted into the through holes of the circuit board by pressing so as to electrically connect and fix the circuit board to the electrically conducting terminals.

20. The lighting apparatus according to claim 19, wherein the flat cable includes at least two power feeding conductors, and at least one electrically conducting terminal is pierced to each of the power feeding conductors so that the electrically conducting terminal and the power feeding conductor are electrically connected to each other.

21. The lighting apparatus according to claim 19, wherein a cross section of the cable perpendicular to the longitudinal direction of the cable has a set of opposing sides which have different dimensions and/or different shapes.

22. The lighting apparatus according to claim 19, wherein the electrically conducting terminal has an intermediate portion embedded in the main body of the case, a distal end portions to be pierced into the cable and a rear end portions to be inserted into the through holes of the circuit board by pressing, wherein the distal end portion is sharpened, and the rear end portion has an expanded part to be fit in the though hole.

23. The lighting apparatus according to claim 22, wherein the intermediate portion is made wider than the distal end and the rear end portion.

24. The lighting apparatus according to claim 19, wherein the case further includes a cable guide fastened onto the back of the main body of the case, the cable guide having a slidable plate, wherein the main body of the case has a rail groove into which the slidable plate is inserted, and a distal end portion of the electrically conducting terminal protrudes on the back of the main body, wherein the cable is held between the main body and the cable guide.

25. The lighting apparatus according to claim 19, further comprising a mask secured on a light emitting surface side of the main body of the case.

26. The lighting apparatus according to claim 19, wherein the through holes are arranged so that the arrangement thereof is not an axially symmetrical arrangement nor a point-symmetrical arrangement.

27. The lighting apparatus according to claim 19, wherein the lighting device is mounted on a light emitting surface of the circuit board, and the control device is mounted on a back surface of the circuit board.

* * * * *